US011626091B2

(12) United States Patent
Ramos

(10) Patent No.: US 11,626,091 B2
(45) Date of Patent: Apr. 11, 2023

(54) DRUM SOUND CONTROL MECHANISM

(71) Applicant: Arturo Ramos, Union City, CA (US)

(72) Inventor: Arturo Ramos, Union City, CA (US)

( * ) Notice: Subject to any disclaimer, the term of this patent is extended or adjusted under 35 U.S.C. 154(b) by 0 days.

(21) Appl. No.: 16/951,090

(22) Filed: Nov. 18, 2020

(65) Prior Publication Data

US 2022/0157280 A1 May 19, 2022

(51) Int. Cl.
*G10D 13/16* (2020.01)
*G10D 13/02* (2020.01)

(52) U.S. Cl.
CPC ..... *G10D 13/16* (2020.02); *G10D 13/02* (2013.01)

(58) Field of Classification Search
CPC ..... G10D 13/16; G10D 13/02
See application file for complete search history.

(56) References Cited

U.S. PATENT DOCUMENTS 3,724,313 A * 4/1973 Frigo ..... G10D 13/02 84/452 P
4,026,185 A * 5/1977 Migirian ..... G10D 13/20 84/411 R
5,157,212 A * 10/1992 Fleming ..... G10D 13/16 84/413
10,805,717 B2 * 10/2020 May ..... G10D 13/02

FOREIGN PATENT DOCUMENTS

CN 111862905 A * 10/2020
GB 2518672 A * 4/2015 ..... G10D 13/10

* cited by examiner

*Primary Examiner* — Jianchun Qin
(74) *Attorney, Agent, or Firm* — Cynthia S. Lamon; Lamon Patent Services

(57) ABSTRACT

A tuning system enabled to be installed inside a drum percussion musical instrument is provided comprising a cylindrical drum shell having a batter head at a top, a bottom, and one or more internal tuning assemblies (ITAs) installed within an inner volume of the drum shell. Sound elements created by striking the batter head of the drum includes any one or more of pitch, resonance and amplitude and are altered, thereby providing tuning of the drum via manipulation of the one or more of the ITAs.

14 Claims, 13 Drawing Sheets

DRUM SOUND CONTROL MECHANISM

BACKGROUND OF THE INVENTION

1. Field of the Invention

The present invention is in the field of musical instruments: specifically, percussion instruments. The present invention relates to the art of tuning or otherwise modifying the quality of the sound output from the drum.

2. Discussion of the State of the Art

Sound production from most percussion instruments, for example, drums, may be due to the vibration of batter heads, and the vibration of an air column. Tuning a drum typically includes manipulating amplitude which may be defined as maximum displacement of a vibrating particle from its mean or equilibrium position. The loudness or volume of sound depends on its amplitude.

The number of vibrations per second is called the frequency. Frequency is measured hertz (Hz). The pitch of sound depends on its frequency, wherein sounds are higher or lower in pitch according to the frequency being high (880 Hz or low (55 Hz), for example. Sound produced by any means has the following characteristics: namely, loudness, pitch or shrillness, and quality or timbre.

In the field of percussion instruments, the art of changing the quality of the sound emanating from a percussion instrument such as drums is limited to changing tension in the batter head and or in the resonant head. Tension in the heads affect the output sound's frequency. Methods of changing other qualities of sound include adding pads at either of the heads. The problem in these methods is that the outcome of the sound quality is not consistent and cannot be varied quickly enough to achieve desired sound quality.

A percussion instrument, such as a drum set, typically consists of a combination of cymbals, Toms, snare drums, and a base drum. A typical drum has a batter head and resonant head that are on top and bottom of the drum respectively. The batter head in tension, when hit, vibrates and produces sound. This sound is reverberated by the resonant head. The sound waves between the heads pass through the air column between them.

The sound output of a drum depends on various factors including the tension and gap between the batter and resonant heads. The air column between these heads through which sound waves pass also contributes to the sound quality. The air column affects the resonance and output sound.

What is needed is a tuning mechanism for a drum enabling more flexibility in the variance of pitch and volume available from a drum, consistency of sound as well as speed of tuning, even enabling tuning during play.

SUMMARY OF THE INVENTION

A tuning system enabled to be installed inside a drum percussion musical instrument is provided and may include a cylindrical drum shell with a batter head at a top, a bottom, and one or more internal tuning assemblies (ITAs) installed within an inner volume of the drum shell. Sound elements of the drum including any one or more of pitch, resonance and amplitude may be altered or tuned via manipulation of the one or more ITAs.

In one embodiment, the one or more ITAs are mounted in a horizontal orientation parallel with the drumhead. In this embodiment, one of the one or more ITAs is a vertical translating disc. The vertical translating disc may further include a support ring fastened to said drum, a threaded rod installed slidably through said support ring, a disc attached to the threaded rod, and a nut engaging with said threaded rod, when turned, translates the disc vertically up or down to vary the space between said batter head and said disc thereby generating required sound from the drum. In this embodiment, the disc is translated up and down the threaded rod with a pulley system comprising, a driven pulley engaged with the nut, the drive pulley installed outside the drum and a drive belt may turn said driven pulley by said drive pulley.

In a separate embodiment, one of the one or more ITAs is a plurality of louvers operating in unison and mounted on a support frame fastened to said drum. This embodiment provides that the plurality of louvers are mounted on the support frame with axis rods mounted rotatably on said support frame by hinges and connected by connecting rods to interfere with soundwaves created by striking the batter head. In this embodiment, a screw is coaxially attached to one of said louvers that extends outside of said drum to operate said louver, and a nut positioned on the screw is manipulated to lock the orientation of said louver by engaging with said drum.

Another embodiment provides an ITA as a set of sliding plates including a fixed plate fastened inside said drum and a sliding plate rotatably located on said fixed plate through an axis pin to alter the passage area of sound emanating from said batter head by turning said sliding plate to generate required sound quality. In this embodiment, one end of a torsion spring is rigidly attached to said axis pin and the other end is attached to said sliding plate and a first cord is attached to said sliding plate and a second end of the torsion spring connects to a clasp outside of said drum shell to orient and lock said sliding plate in place from outside said drum.

BRIEF DESCRIPTION OF THE DRAWING FIGURES

DETAILED DESCRIPTION

The inventor provides various embodiments of assemblies that control the sound quality of the drum. The present invention is described in enabling detail using the following examples, which may describe more than one relevant embodiment falling within the scope of the present invention.

Figure 1:
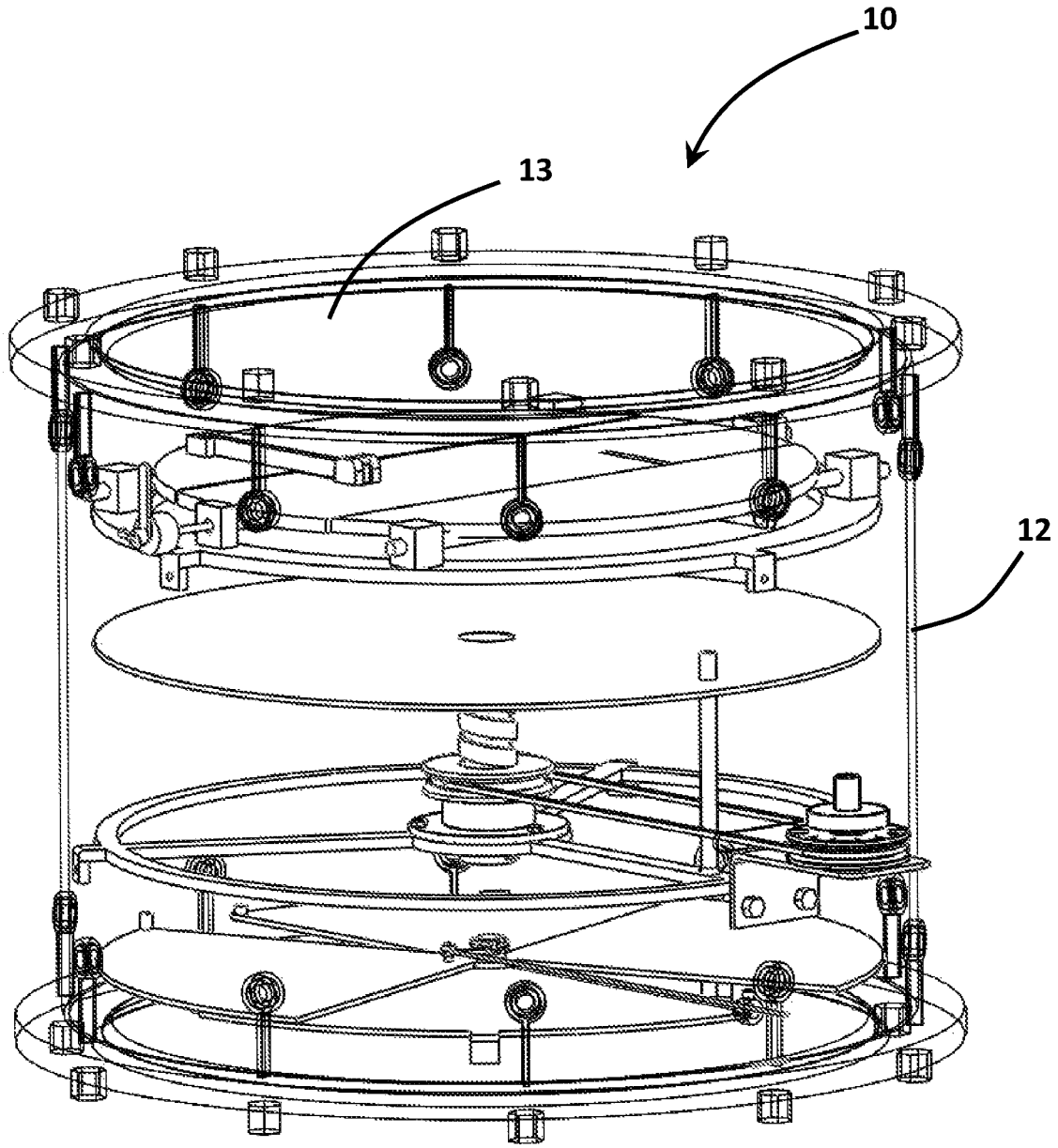
FIG. 1 is a perspective view of various embodiments of a drum with internal tuning assemblies (ITAs) of the invention.

FIG. 1 is a perspective view of the drum 10 within which various internal tuning assemblies (ITAs) of the invention are installed. FIG. 1 shows a transparent batter head 13 enabling view of internal elements of the drum. The drum shell 12 is also shown transparent. Internal ITAs are shown in one embodiment separated vertically where The louver ITA 30 at the top, below the batter head 13. Vertically moving disc ITA 20 in a center position allowing room to translate vertically and sliding disc ITA 40 is in a lower position near a bottom portion of the drum.

Figure 2:
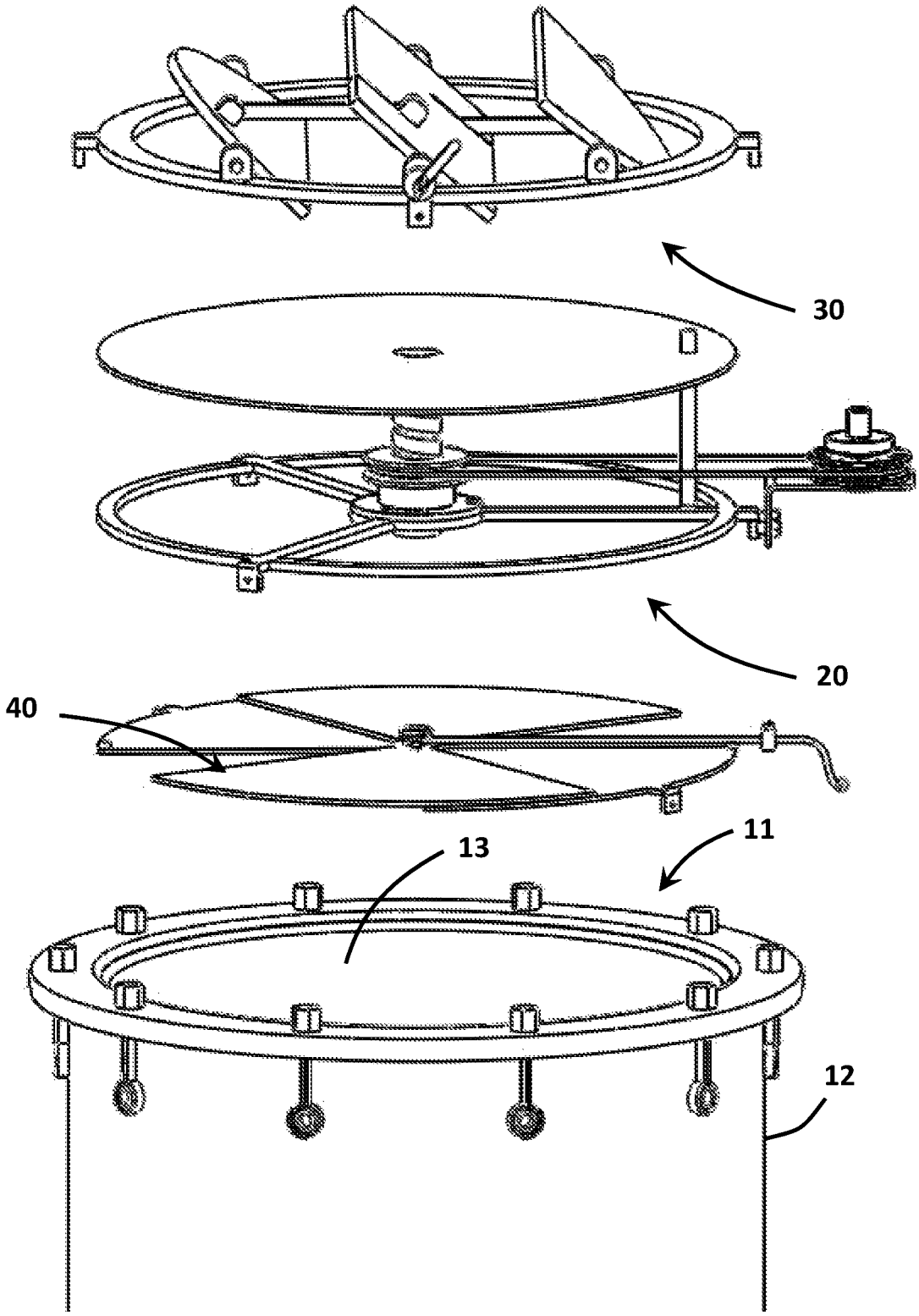
FIG. 2 is a perspective exploded view of the ITAs within the drum

FIG. 2 shows a perspective exploded view of the ITAs of FIG. 1 reproduced for clarity. Louver ITA 30, axially moving disc ITA 20, and sliding disc ITA 40 are enabled to operate within an inner volume of drum 11. The ITAs are attached to the drum shell 12 in a horizontal orientation that may be parallel to the batter head 13, in this embodiment. The invention is not necessarily dependent upon the orientation shown in FIG. 2. One embodiment may include only two ITAs, or even one may be placed within the drum. Other embodiments may switch position of the ITAs where the sliding disc ITA 40 may be at the top position of the drum and the louvre ITA 30 at the bottom. There really is no limitation of the arrangement of ITAs within the drum other than requiring adequate room for vertical translation of vertically moving disc ITA 20.

Figure 3:
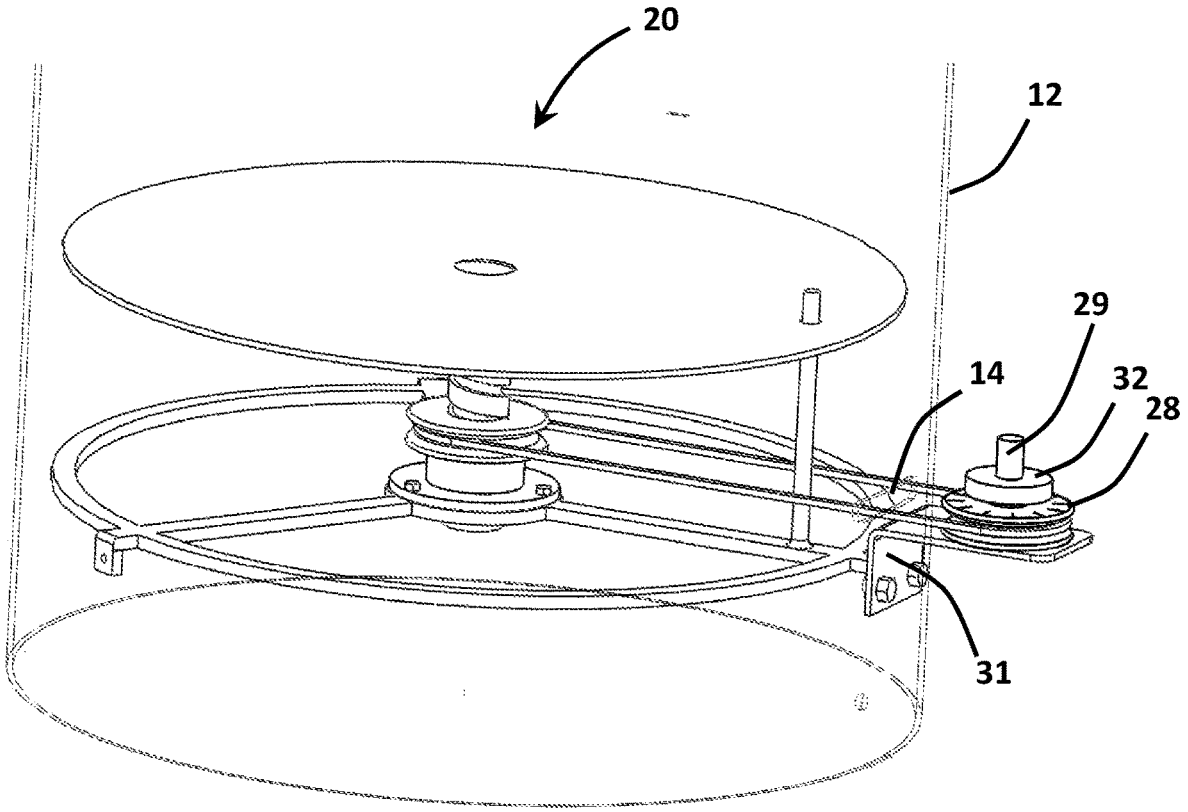
FIG. 3 is a section view of the drum showing a moving disc ITA inside the drum shell.

In one embodiment, according to FIG. 3, a perspective view of the disc ITA 20 is shown inside the drum shell 12. The disc ITA 20 is predominantly inside and a controlling portion extends to outside of the drum shell 12 through an opening 14 to facilitate control of height of the disc ITA 20 from outside the drum.

Figure 4:
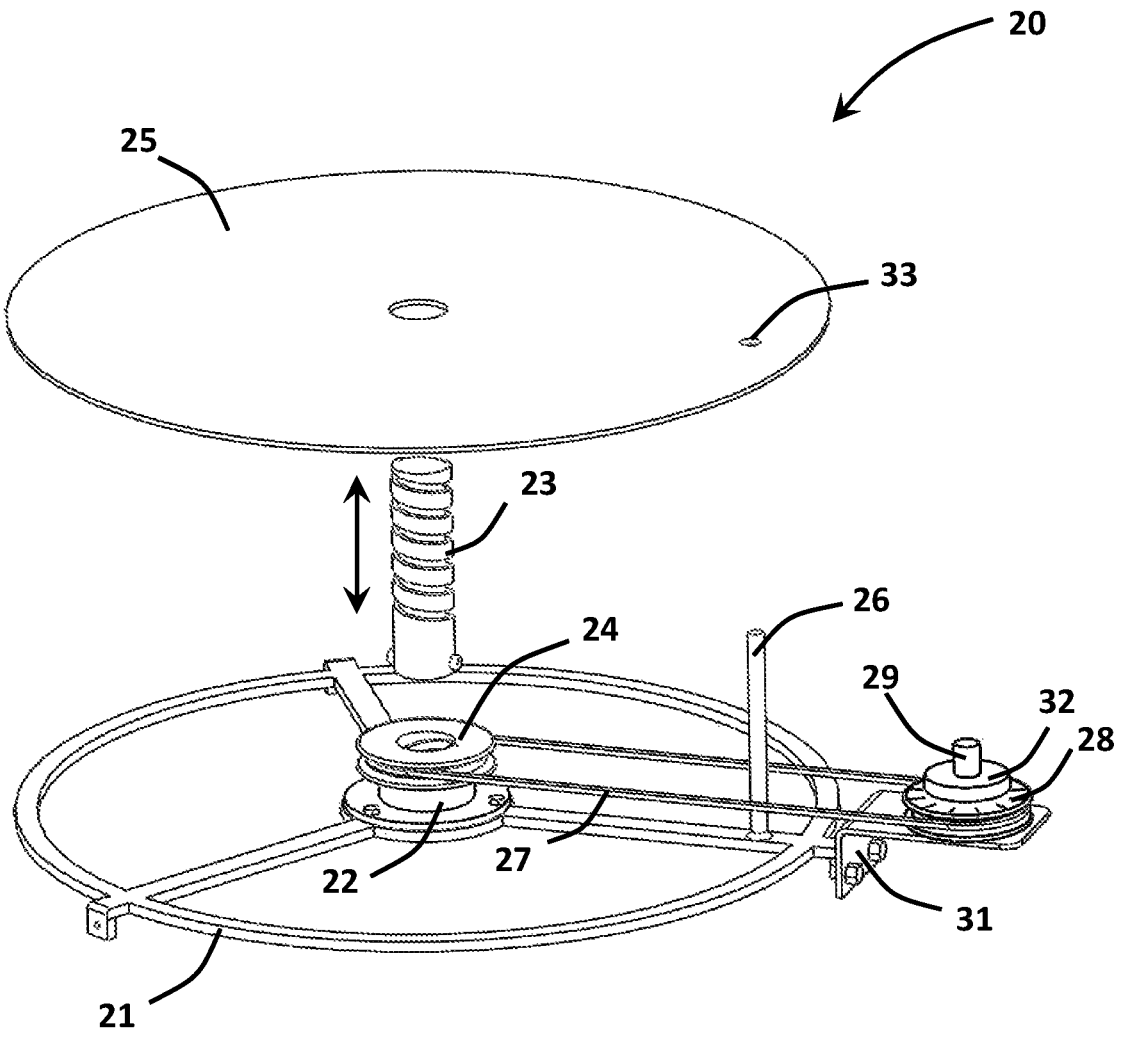
FIG. 4 is a perspective exploded view of the moving disc.

FIG. 4 is a perspective exploded view of the disc ITA 20. A support frame 21 that is fastened by screws to the drum shell, not shown in figure, has a bushing 22 in the center through which a threaded rod 23 slides through up and down. A nut pulley 24 with threads inside to mate with the threaded rod 23 slides over the bushing 22. When the nut pulley 24 is turned the threaded rod 23 moves up or down. A flat planar circular disc 25 is rigidly attached at the top end of the threaded rod 23 and moves parallel to the batter head 13 when the nut pulley 24 is turned one direction to translate disc 25 toward the batter head 13 and nut pulley 24 is turned in an opposite direction thereby translating disc 25 away from the batter head 13. Changing the amount of space between the batter head 13 and the disc 25 alters the sound output from the drum by altering open space within an inner volume within the drum. More space creates a louder sound with more resonance and a smaller space decreases volume and resonance.

In one embodiment, when the nut pulley 24 is turned it is possible the threaded rod 23 and flat disc 25 turn together preventing up and down movement of disc 25 on the threads 23, thereby maintaining the disc 25 in a stationary position. An anti-rotation rod 26 may be perpendicularly attached to support frame 21 and may pass through a small hole 33 in the flat disc 25. The nut pulley 24 is driven by a drive pulley 28 through a belt 27 that passes through the opening 14 shown in FIG. 3. The drive pulley 28 revolves on an axis screw 29 supported by a bracket 31 fastened by screws to the drum shell 12 shown in FIG. 3. The drive pulley 28 is graduated to guide the user to know the extent to which the nut pulley 24 has raised the flat disc 25. Once the flat disc 25 is at the desired height, the drive pulley 28 may be locked down in place by a lock nut 32 that is engaged with axis screw 29. Due to the tension in the belt 27 the nut pulley cannot independently turn without turning the drive pulley 28. In this embodiment, the flat disc 25 is locked in place when the drive pulley 28 is also locked. This facilitates modifying the sound output in a fast and reliable process.

Figure 5:
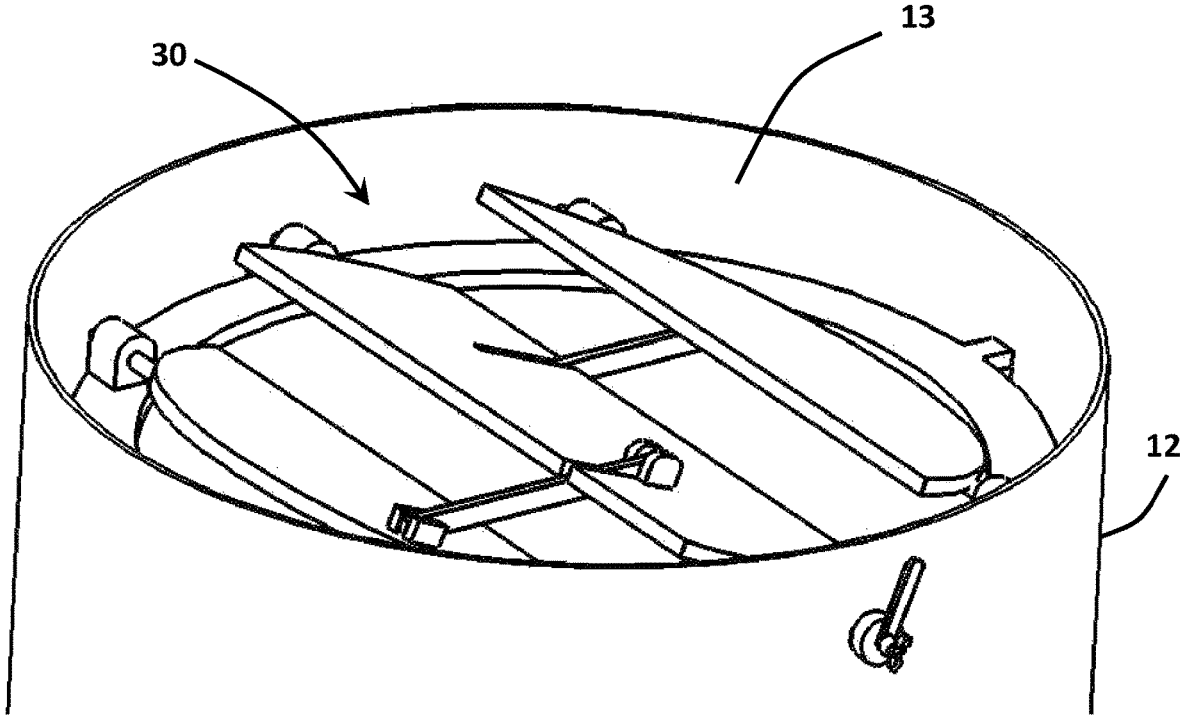
FIG. 5 is a section view of the drum with a louver ITA shown inside the drum shell.

FIG. 5 depict the louver ITA 30 installed inside the drum shell 12 parallel to the batter head 13. In this view, the batter head is transparent in order to facilitate viewing. This view accurately depicts a possible placement of louvre ITA 30 from a top or where the batter head 13 is placed. This placement may be lower than seen in FIG. 5, but not necessarily higher as the batter head 13 needs to fit tight around a top rim of the drum shell 12.

Figure 6A:
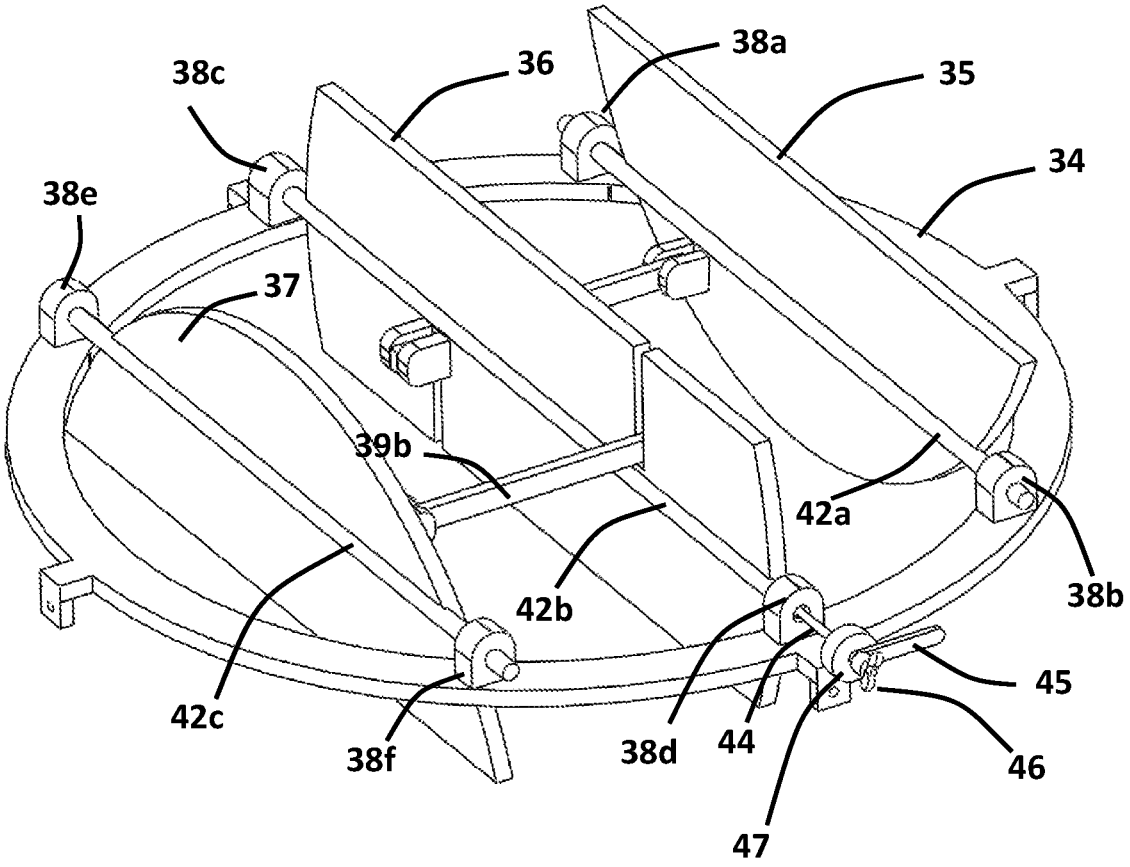
FIG. 6A is a perspective view of the louver ITA in a fully open position.
Figure 6B:
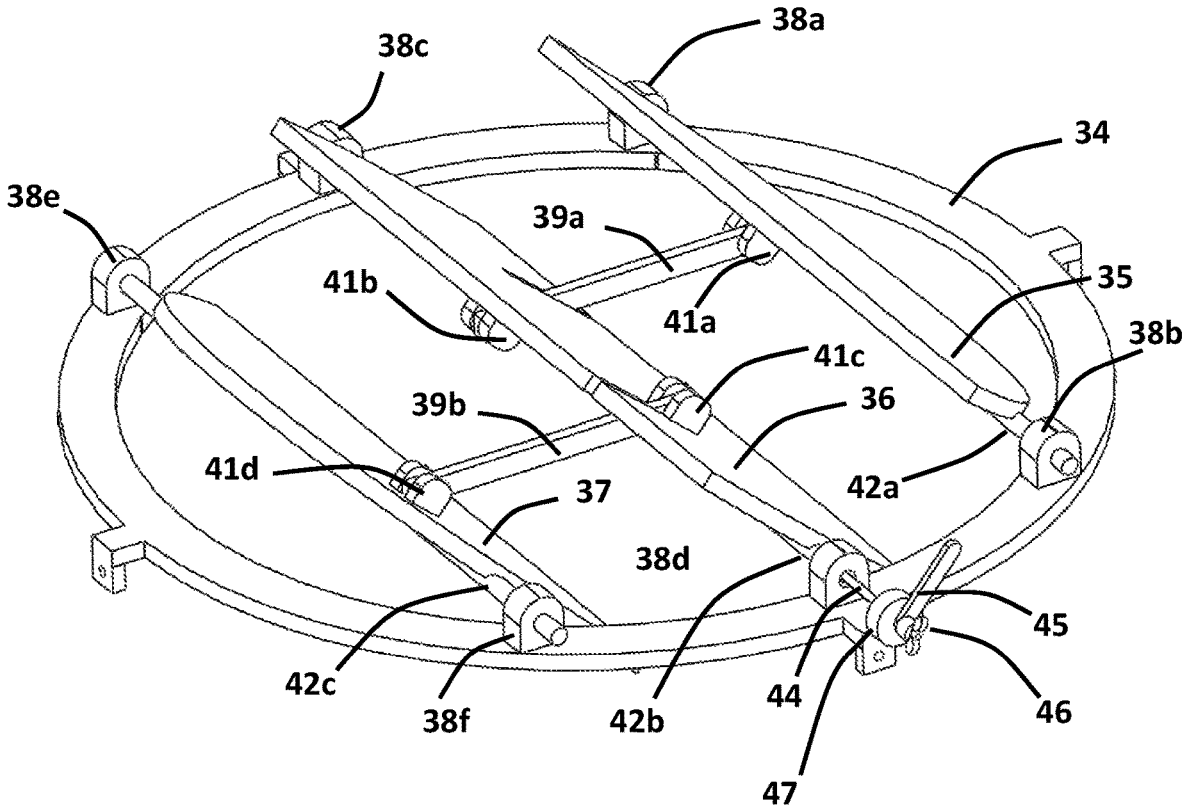
FIG. 6B is a perspective view of the louver ITA in a partially open position.

FIG. 6A shows the louver ITA 30 in a fully open position where a set of louvers 35, 36 and 37 are oriented substantially vertically allowing air movement through with very little interruption. FIG. 6B shows louver ITA 30 isolated from the drum shell 13. In this embodiment, a partially open louver ITA 30, is shown in a perspective view, comprising a louver support ring 34 supporting three louvers 35, 36 and 37 through their respective rotational axis rods 42*a*, 42*b* and 42*c* by hinges 38*a*, 38*b*, 38*c*, 38*d*, 38*e* and 38*f* connected directly to ring 34. The support ring 34 is fastened to the drum shell 12 with screws, a ledge or lip extending orthogonally from an inner surface of drum shell 12 or by any other means. Connecting arms 39*a* and 39*b* connect louvers 35 and 36, and 36 and 37 respectively by hinge joints 41*a*, 41*b*, 41*c* and 41*d* placed on the louver's surface or through a slot opening to a surface via a slot, as in louver 30, enabling the louvers to move in unison.

Figure 6C:
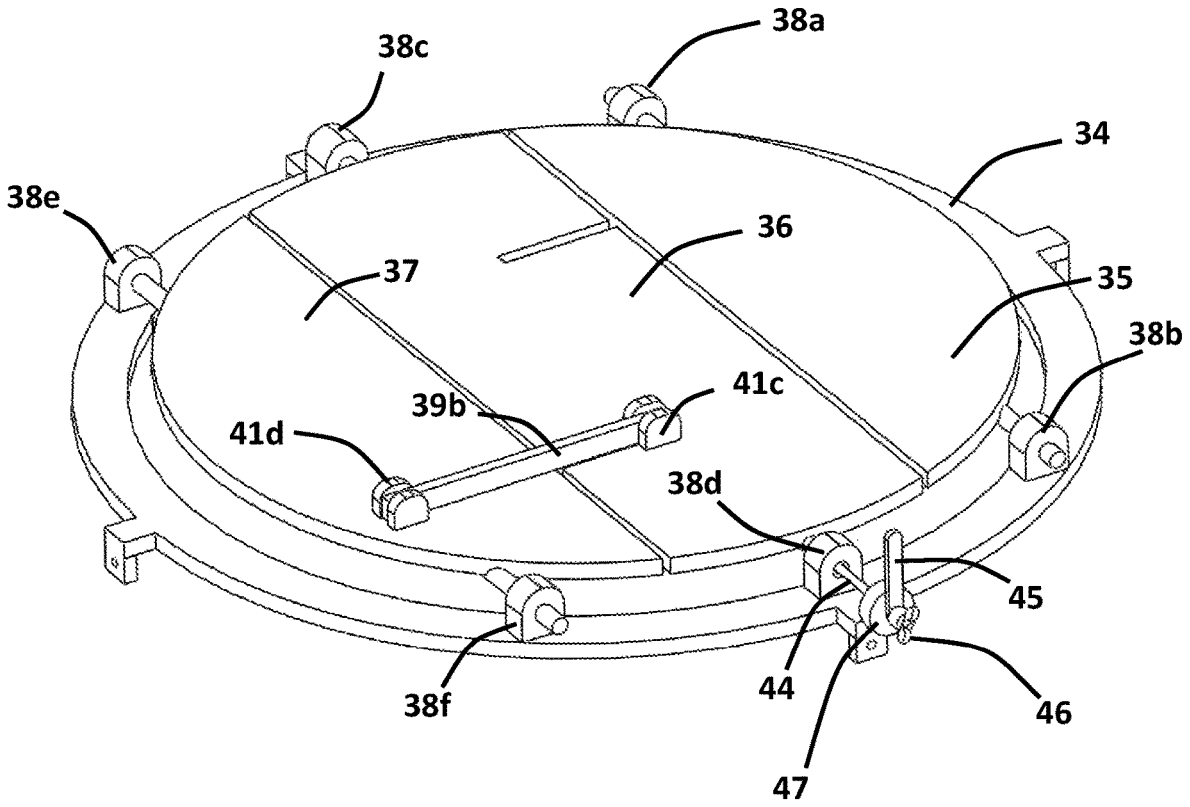
FIG. 6C is a perspective view of the louver ITA in a fully closed position.

The connections between the louvers is such that all the louvers are parallel to each other. When the louver 36 in the middle is rotated louvers 35 and 37 on either side of it rotate at the same angle and maintain parallelism. When louver 36 is horizontal, it brings the other louvers 35 and 37 to the horizontal position as well, thereby closing the air gap through the support ring. In the same principle, when the center louver is vertical along with the rest of the louvers the air path is nearly open supporting sound wave and air passage. The quality of the drum's sound output differs in these two and in-between positions. A screw 44, co-axially attached to the middle louver axis at one end, comes from inside to outside of the drum shell through a bushing 47 attached to the external wall of the drum shell. An indicator bar 45, oriented perpendicular to the flat surface of the center louver 36 is rigidly fixed on to the screw 44. This indicator bar 45, outside of the drum shell, is turned to position the louvers, as required. Once the louvers are in the required orientation the indicator is locked in place by a wing nut 46 against the bushing 47. In this partially open orientation air waves are diverted around the louvers 35, 36 and 37 thereby affecting loudness and timbre or bass. FIG. 6C shows the louver ITA 30 with the louvers 35,36 and 37 in horizontal orientation thereby not allowing most of the sound waves rebounded instead of a pass through. one with skill in the art would readily recognize this position may damper amplitude and frequency.

Figure 7:
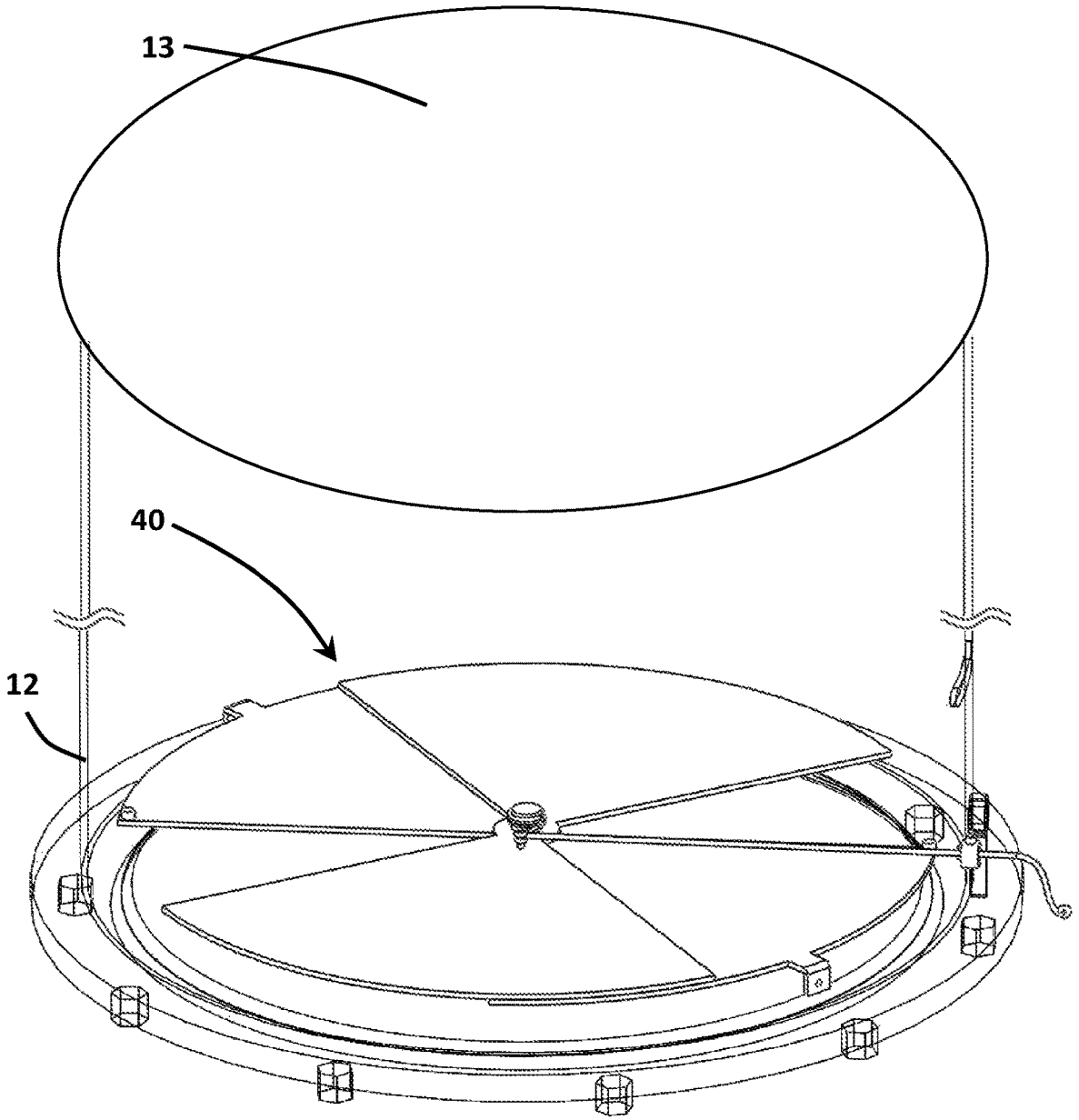
FIG. 7 is a perspective section view of the drum showing a sliding disc ITA shown inside the drum.

FIG. 7 shows a perspective view of a sliding disc ITA 40 inside the drum shell 12 parallel to the batter head 13 of FIG. 6C. The sliding disc ITA 40 is shown in a perspective view in FIG. 8A fully closed and rebounding most of the soundwaves. In this embodiment, the bottom of the drum shell 12 may be open, having no cover. The sliding disc ITA 40 controls volume by fully resonating sound within the drum when the sliding disc 40 is in a fully closed position, or incrementally controlling volume based on an amount of opening or the sliding plates as seen in FIGS. 8A-8C.

Figure 8A:
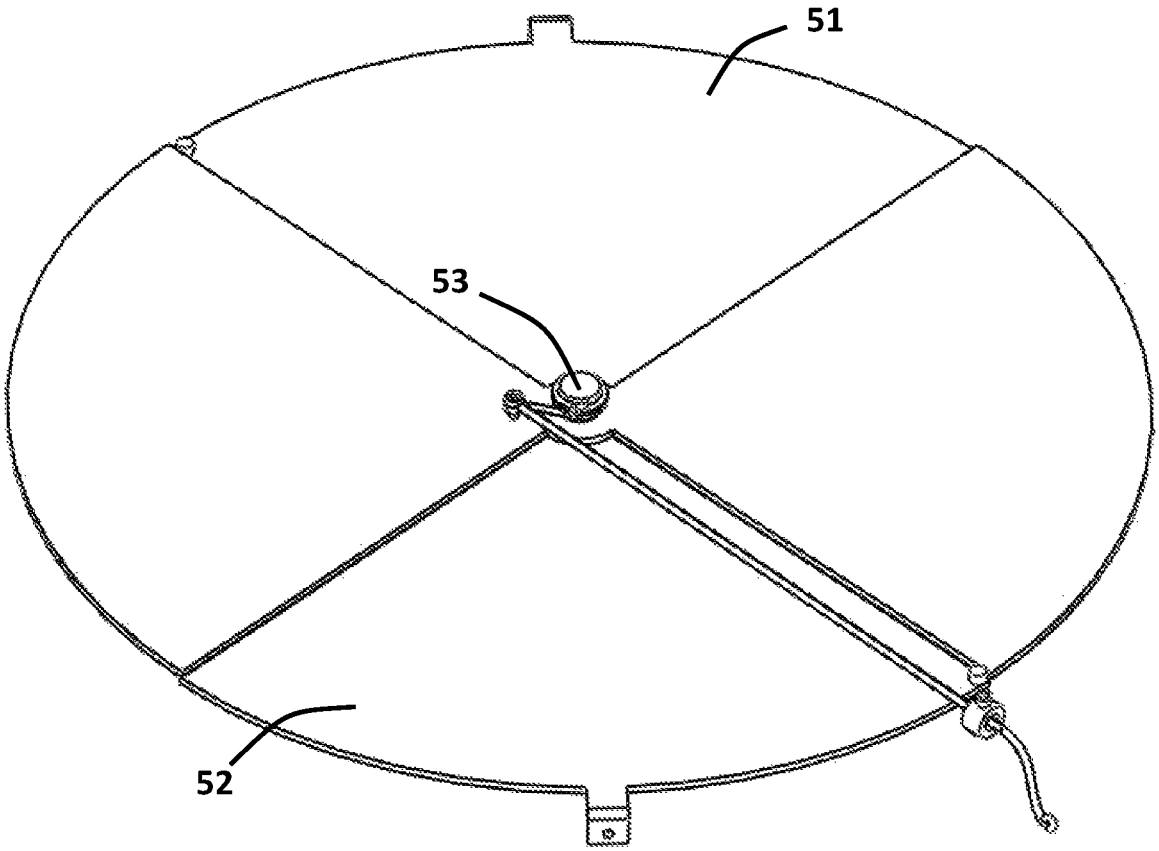
FIG. 8A is a perspective view of the sliding disc ITA fully closed.
Figure 8B:
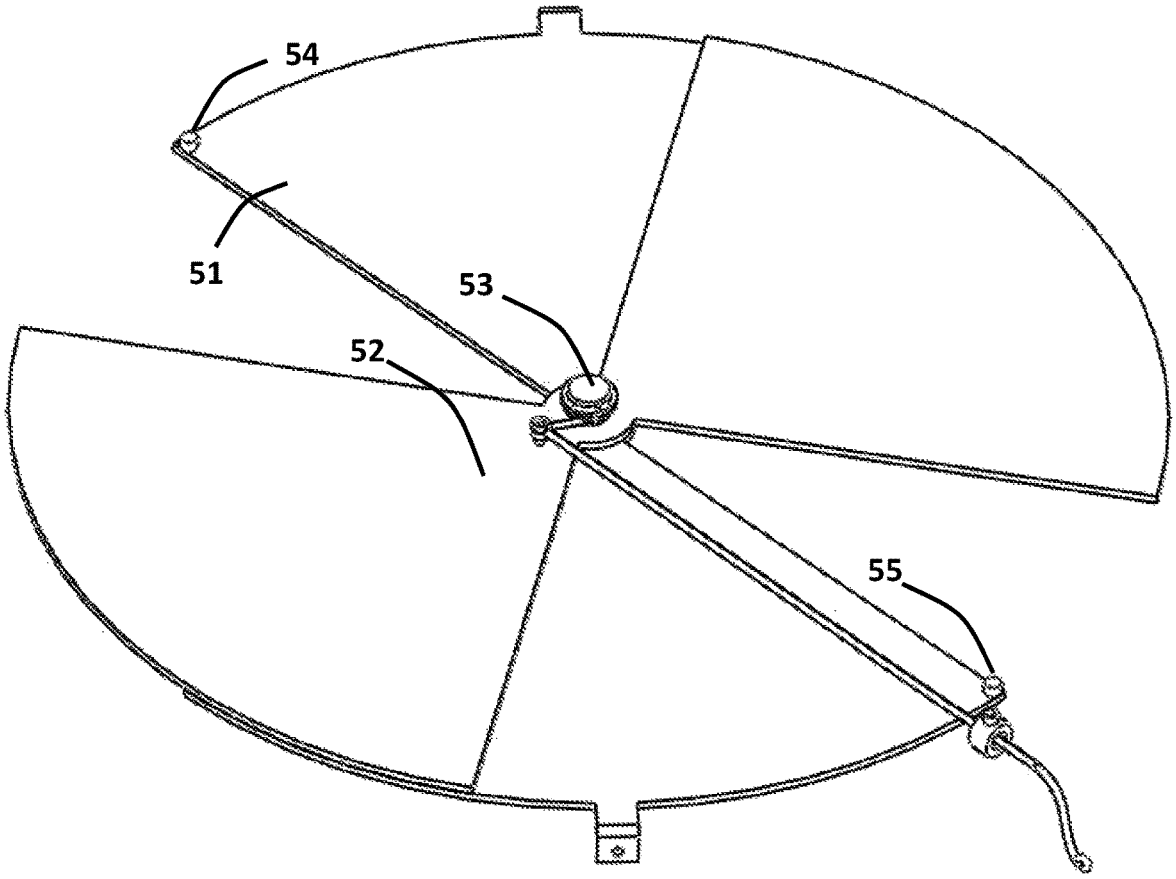
FIG. 8B is a perspective view of the sliding disc ITA partially open.
Figure 8C:
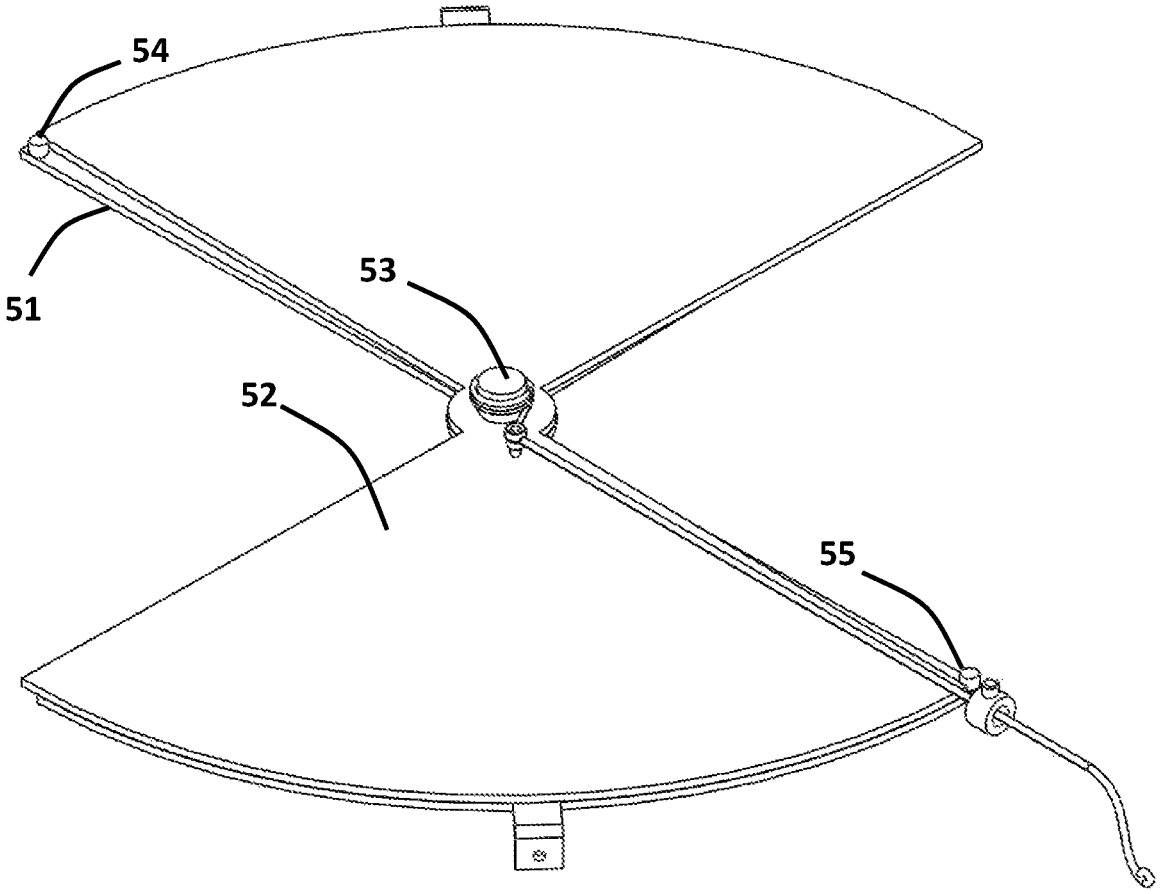
FIG. 8C is a perspective view of the sliding disc ITA fully open.

FIG. 8A shows ITA 40 in a completely closed position. In FIG. 8B, the sliding plate ITA 40, partially open, comprising a fixed plate 51 fastened by screws inside the drum shell 12 shown in FIG. 7. An axis pin 53 is attached rigidly to the center hole at the fixed plate 51 serves as the axis of rotation for the sliding plate 52. A sliding plate 52 with similar geometry of fixed plate 51 positioned coaxially above the fixed plate 51 rotates over plate 51. Each plate is shaped as two pie shaped sections of a circle connected at the center with a coaxial hole 56. When the fixed and sliding plates are congruent the sliding disc ITA is open fully. When the sliding plate 52 is rotated over the fixed plate 51 the area of air gap changes from a range of fully closed to partially closed. There are two tabs on the fixed plate 51 namely close limit tab 54 and open limit tab 55 that limit the closing and opening of the sliding plate 52.

In this partially open position, some of the sound waves are let through while the some are rebound. FIG. 8C shows the sliding plate ITA 40 in fully open position where more sound waves are allowed pass through than the partially open position.

Figure 9:
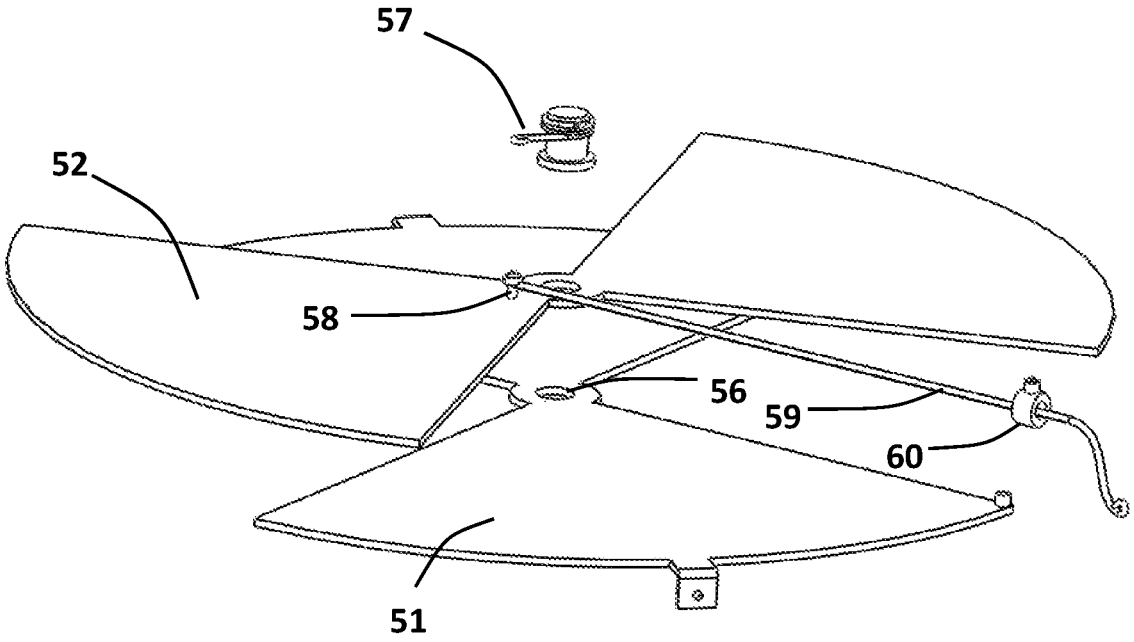
FIG. 9 is a perspective exploded view of the sliding disc ITA.

FIG. 9 is an exploded perspective view of the sliding plate ITA 40. To facilitate operation from outside of the drum shell a cord 59, one end of which is attached to a cord pin 58 at the sliding plate 52 while the other end is free with a knot. A torsion spring 57, one end of which is rigidly attached to the axis pin 53 of FIG. 8A and the other end is wound around the cord pin 58. The torsion spring 57 is biased to keep the sliding plate 52 in contact with the closing limit tab. The cord 59, passes through clasp 60 attached to the drum shell, is pulled outward to move the sliding plate 52 to the open position. The tab in clasp 60 is pressed to enable the cord 59 sliding through the clasp 60. When the tab is released the cord 59 is locked in place, also locking the sliding plate 52 because of the bias in the torsion spring 57 acts away from the pulling direction of the cord 59. The cord 59 has markings on it to indicate fully opened and closed position of the sliding plate 52. The user can engage the clasp 60 at desired setting for the sound output.

Various assemblies detailed in this invention can be installed in the drum need not follow the orientations depicted. The number and choice of assemblies and their positions or orientation of installation can vary per the needs of the user. For example, there can be more than one louver ITA and not the sliding plate ITA, installed. Additionally, specific modes of operation are not limiting as there are many ways to control the ITAs within the drum shell 12 that are within the scope of the invention. The skilled person will recognize that the embodiments described, herein, and illustrated in the Figures are merely examples of the apparatus and method of use that are within the breadth of the present invention. The invention is limited only by the claims that follow.

What is claimed is:

1. A tuning system enabled to be installed inside a drum percussion musical instrument, comprising;

a cylindrical drum shell with a batter head at a top, a bottom, an inner volume functioning as a resonance chamber having a depth between the batter head and the bottom, and at least two internal tuning assemblies (ITAs) installed within the resonance chamber, a first one of ITAs is a planar solid disc having a diameter substantially the same as a diameter of the batter head, and a second one of the ITAs includes the substantially similar diameter and is enabled to be adjusted to create openings;

wherein sound elements of the drum including any one or more of pitch, resonance, and amplitude are changed via manipulation of the ITAs by translating the ITAs along the depth below the batter head, thereby altering the inner volume of the resonance chamber.

2. The system of claim 1, wherein the ITAs are mounted in a horizontal orientation parallel with the batter head.

3. The system of claim 1, wherein at least one of the ITAs is a vertical translating disc.

4. The system of claim 3, wherein the vertical translating disc further includes;

a support ring fastened to said drum;

a threaded rod installed slidably through said support ring a disc attached to the threaded rod; and a nut engaging with said threaded rod, when turned, translates the disc vertically up or down to vary the space between said batter head and said disc thereby generating required sound from the drum.

5. The system of claim 4, wherein a pulley system translates the disc, comprising;

a driven pulley engaged with said nut;

a drive pulley installed outside said drum; and a drive belt to turn said driven pulley by said drive pulley.

6. The system of claim 1, wherein the second one of the ITAs includes a plurality of louvers operating in unison and mounted on a support frame fastened to said drum.

7. The system of claim 6, wherein the plurality of louvers is mounted on the support frame with axis rods mounted rotatably on said support frame by hinges and connected by connecting rods to interfere with soundwaves created by striking the batter head.

8. The system of claim 7, wherein a screw is coaxially attached to one of said louvers that extends outside of said drum to operate said louver and a nut positioned on the screw is manipulated to lock the orientation of said louver by engaging with said drum.

9. The system of claim 1, wherein the second one of the ITAs includes a set of sliding plates including a fixed plate fastened inside said drum and a sliding plate rotatably located on said fixed plate through an axis pin to alter the passage area of sound emanating from said batter head by turning said sliding plate to generate required sound quality.

10. The system of claim 9, wherein one end of a torsion spring is rigidly attached to said axis pin and the other end is attached to said sliding plate and a first end of a cord is attached to said sliding plate and a second end of the cord connects to a clasp outside said drum shell to orient and lock said sliding plate in place from outside said drum.

11. A tuning system enabled to be installed inside a drum percussion musical instrument, comprising;

a cylindrical drum shell with a batter head at a top, a bottom, an inner volume functioning as a resonance chamber having a depth between the batter head and the bottom, and at least one internal tuning assembly (ITA) installed within the resonance chamber;

wherein one of the at least one ITAs is a plurality of louvers operating in unison and mounted on a support frame with axis rods mounted rotatably on said support frame by hinges and connected by connecting rods to interfere with soundwaves created by striking the batter head, and sound elements of the drum including any one or more of pitch, resonance, and amplitude are changed via manipulation of said plurality of louvers.

12. The system of claim 11, wherein a screw is coaxially attached to one of said louvers that extends outside of said drum to operate said louver and a nut positioned on the screw is manipulated to lock the orientation of said louver by engaging with said drum.

13. A tuning system enabled to be installed inside a drum percussion musical instrument, comprising;

a cylindrical drum shell with a batter head at a top, a bottom, and an inner volume functioning a resonance chamber between the batter head and the bottom;

at least one internal tuning assembly (ITA) installed within said resonance chamber and having a diameter substantially similar to a diameter of the batter head, the at least one ITA comprising a set of plates including a fixed plate and a sliding plate rotatably located on said fixed plate through an axis;

wherein turning said sliding plate causes changes in alignment between apertures in said fixed plate and said sliding plate, thereby manipulating airflow between said batter head and said bottom and changing resonance properties of said resonance chamber.

14. The tuning system of claim 13 wherein one end of a torsion spring is rigidly attached to said axis pin and another end of said torsion spring is attached to said sliding plate and a first end of a cord is attached to said sliding plate and a second end of said cord is connected to a clasp outside said drum shell to orient and lock said sliding plate in place from outside said drum.

* * * * *